US006375392B1

(12) United States Patent
Verstraeten

(10) Patent No.: US 6,375,392 B1
(45) Date of Patent: Apr. 23, 2002

(54) METHOD FOR MAKING A WALL IN THE GROUND AND DRILLING ELEMENT USED THEREWITH

(75) Inventor: Alexander Julien Verstraeten, Knokke-Heist (BE)

(73) Assignee: Beheersmaatschappij Verstraeten BV, Oostburg (NL)

( * ) Notice: Subject to any disclaimer, the term of this patent is extended or adjusted under 35 U.S.C. 154(b) by 0 days.

(21) Appl. No.: 09/533,182

(22) Filed: Mar. 22, 2000

(30) Foreign Application Priority Data

Mar. 23, 1999 (BE) ..... 09900204

(51) Int. Cl.[7] ..... E02D 27/00; E02D 29/00; E02D 5/18

(52) U.S. Cl. ..... 405/267

(58) Field of Search ..... 405/267, 268, 405/269, 270, 266, 263, 256, 257, 232, 233, 231, 239, 252, 258, 259.1, 229, 275, 273, 153, 159, 286, 287, 287.1

(56) References Cited

U.S. PATENT DOCUMENTS 4,063,424 A 12/1977 Takagi et al.

5,765,965 A * 6/1998 Carter, Jr. et al. ..... 405/129

FOREIGN PATENT DOCUMENTS

JP 57133919 8/1982

JP 59224720 12/1984

* cited by examiner

*Primary Examiner*—Christopher J. Novosad

(74) *Attorney, Agent, or Firm*—Bacon & Thomas, PLLC

(57) ABSTRACT

A method for constructing an underground wall in a soil formation includes arranging a plurality of drilling pipes in a predetermined pattern adjacent to one another. Each of the drilling pipes has an open distal end, a plurality of teeth radially extending therefrom and at least one channel shaped profile extending along the length thereof. The drilling pipes are rotatably driven into the soil while a hardening liquid is injected into soil loosened by the plurality of teeth. The hardening liquid is agitated and mixed with the loosened soil as each of the drilling pipes is driven into the soil. The mixture of the loosened soil and the hardening liquid is solidified in situ in each of the drilling pipes.

14 Claims, 4 Drawing Sheets

METHOD FOR MAKING A WALL IN THE GROUND AND DRILLING ELEMENT USED THEREWITH

BACKGROUND OF THE INVENTION

1. Field of the Invention

This invention relates to a method for making a wall in the ground, whereby a plurality of drilling elements is drilled into the ground next to each other and at a distance from each other and a hardening liquid is injected into the earth loosened by this drilling.

2. Discussion of the Related Art

Such methods are substantially used for manufacturing water protection walls or water retention walls, for example, temporary waterproof protection walls for cellar constructions, in particular at locations where it is not allowed to vibrate or drive damming plates or such into the ground.

Thereby, it is known to use drilling rods as drilling elements which are provided with spiral-shaped blades over a well-defined height.

By means of a drilling device, three or more such drilling elements are drilled into the ground simultaneously, whereby adjacent drilling rods are rotated in opposite sense in order to keep the torque on the drilling device low.

After having drilled the ground loose, the drilling rods are screwed out of the ground.

During screwing and unscrewing of these drilling rods, cement slurry is injected into the loosened ground which is blended with the latter over the entire diameter of the loosened ground.

In this manner, pillars are formed of a relatively soft mixture of loose ground and cement slurry, the diameter of which is larger than the diameter of the drilling rods and is as large as the diameter of the blades. With drilling rods of a diameter of, for example, 25 cm, a pillar with a diameter of, for example, 60 cm is obtained.

The such formed adjacent pillars overlap each other by approximately 15 centimeters.

After unscrewing the drilling rod from a pillar, a metal I-profile is lowered into this pillar, after which the mixture of ground and cement slurry may harden.

After this hardening, the metal profiles provide for strength and the hardened mixtures for the watertight-ness. It is then possible to excavate next to the formed wall.

In grounds which are hard to blend, such as in tough clay, clods may be created in the mixture which may lead to leaks after hardening.

In such grounds which are hard to blend, and in particular in clay-like grounds, the drilling rod has to be screwed and unscrewed several times, and a large amount of cement slurry has to be injected.

This has as a result that the total volume of the ground to be blended is increased by 70% or more. The surplus ground which is created thereby and which has the consistency of a thick slurry, flows over the building site and is collected in a pit in order to be transported off after stiffening.

This transporting off causes high costs, in particular when the method is applied in city agglomerations.

Besides, according to the environmental rules of many countries, such ground is polluted ground, as a result of which the dumping thereof is expensive.

Together with the transported-off ground, also a large amount of cement is lost. So, for example, with a daily production of 100 $m^3$ ground and cement mixture, daily at least 40 to 70 $m^3$ of ground comprising 12 to 16 tons of cement will be transported off.

SUMMARY OF THE INVENTION

The present invention aims at a method which does not show the aforementioned disadvantages and which involves a minimum of ground and lost hardening material to be transported off and which allows to manufacture a leak-free wall also in grounds which are not easy to blend.

According to the invention, this aim is achieved in that as drilling elements, drilling pipes are brought into the ground which comprise a cylindrical tubular element which is open at one extremity and carries teeth and which is provided with at least one channel-shaped profile which opens at the extremity of the tubular element which is provided with teeth and in that by means of this profile, during drilling, a hardening liquid is injected into the ground uprooted by the teeth, whereby the drilling pipes are left in the ground during the hardening of the mixture of ground and hardening liquid formed by the teeth.

Contrary to the aforementioned known method, only circular pillars of ground, mixed with hardening liquid, are formed, and the drilling pipes remain in the ground.

In the profile of a tubular element, preferably an injection pipe is provided and hardening liquid is injected through this injection pipe.

After reaching the desired depth, this injection pipe can be removed, whereby, during withdrawal of the injection pipe, preferably hardening liquid is injected, too.

Drilling pipes may be used, the tubular element of which comprises two profiles on its outside which are situated diametrically opposite each other and in which an injection pipe is provided through which, during bringing them into the ground, hardening liquid is injected, which injection pipe is removed from the profile after the drilling pipe has reached the desired depth.

Moreover, the profiles may be provided with a groove at the outside, whereby the drilling pipes are stopped in such position that they are situated with a profile opposite to each other, after which a connecting panel is slid with its longitudinal edges into the profiles, situated opposite to each other, of two adjacent drilling pipes, whereby the connecting profile extends through the groove at the outside of the profiles.

In this form of embodiment, the distance between the drilling pipes can be relatively large.

A connecting panel may be used, the longitudinal edges of which are provided with a profile and fit in the profiles at the tubular elements.

An injection pipe may also be provided along the connecting profile, through which hardening liquid is injected, for example, when bringing in this connecting panel, whereby, after bringing in, this injection pipe is withdrawn from the ground. Preferably, two adjacent drilling pipes are drilled into the ground in opposite sense.

Drilling pipes may be used, the teeth of which are that large and are placed in such a manner that they blend ground with the injected hardening liquid up to 15 to 30 mm at the inside of the tubular element and approximately 40 to 50 mm at the outside of the tubular element.

The invention also relates to a drilling element formed by a drilling pipe and clearly destined for application with the method according to any of the preceding forms of embodiment.

BRIEF DESCRIPTION OF THE DRAWINGS

With the intention of better showing the characteristics of the invention, hereafter, as an example without any limitative character, a preferred form of embodiment of a method for making a wall in the ground and of a drilling element used therewith according to the invention are described, with reference to the accompanying drawings, wherein.

DESCRIPTION OF THE PREFERRED EMBODIMENT

Figure 1:
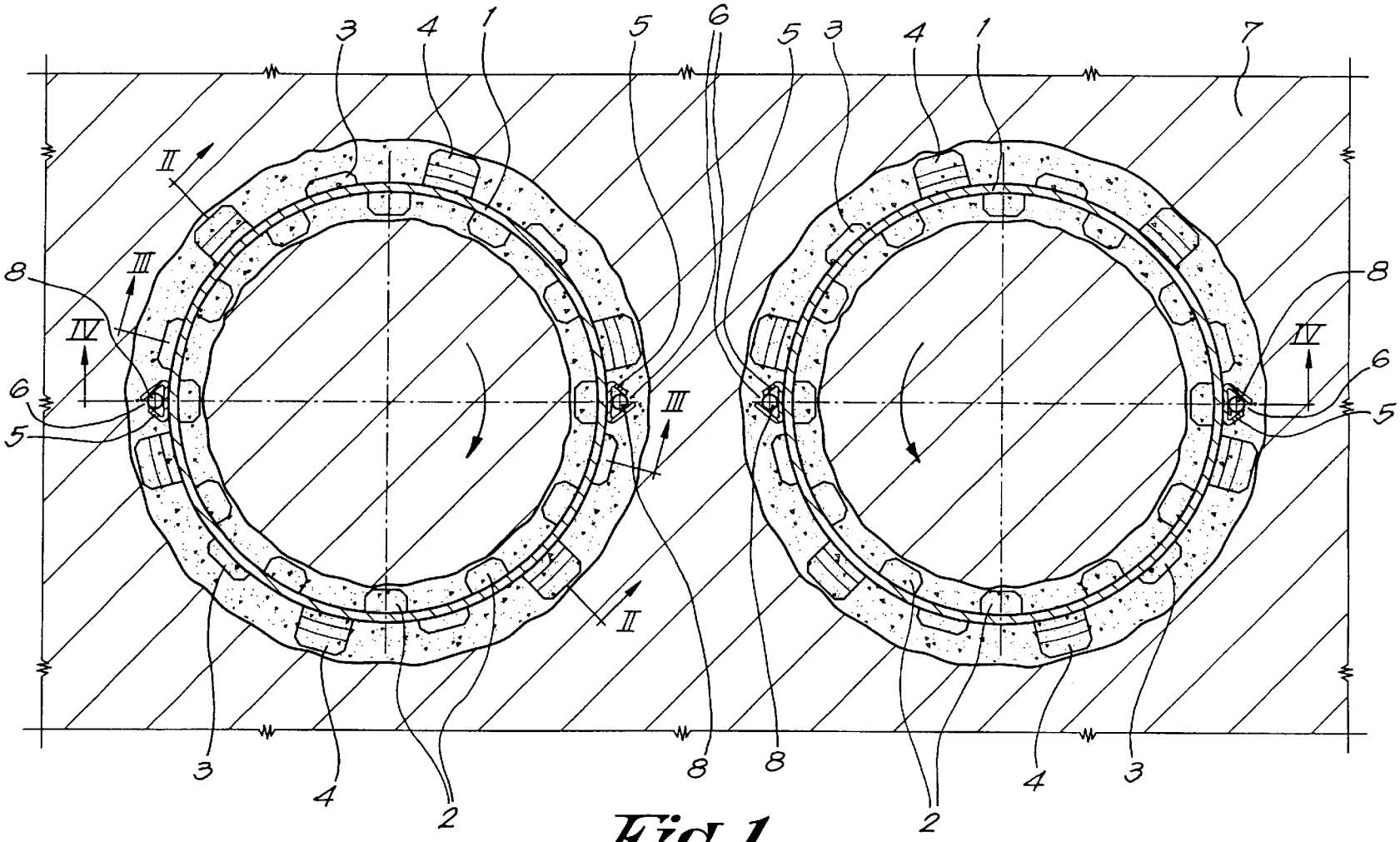
FIG. 1 represents a horizontal cross-section of two drilling pipes according to the invention during making a wall in the ground.
Figure 2:
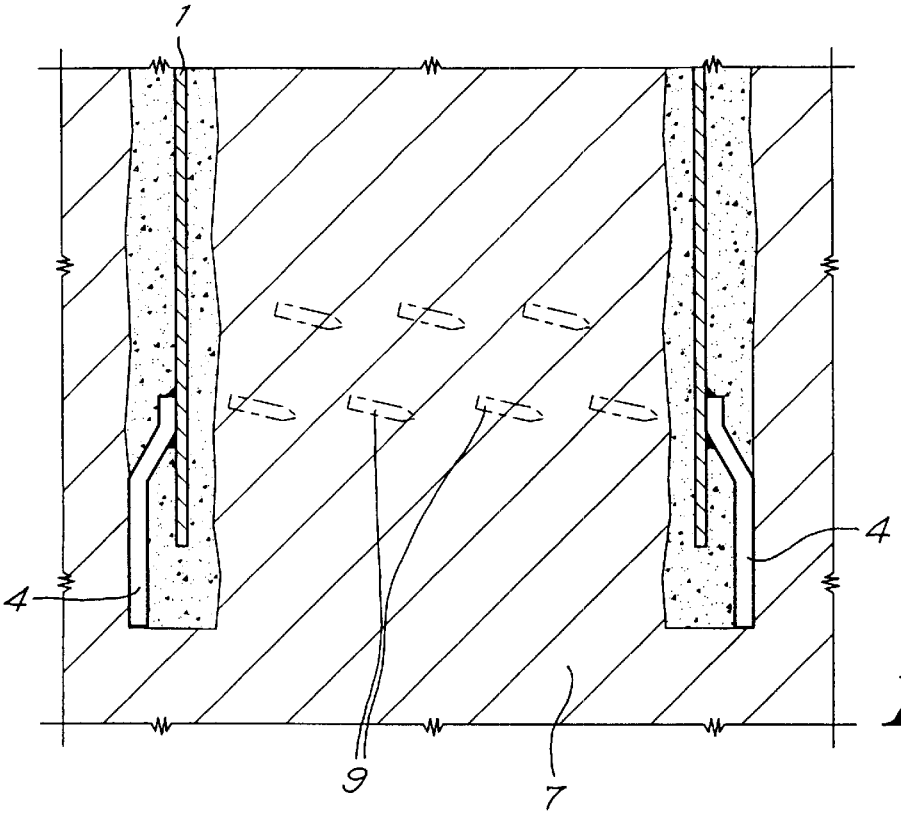
FIG. 2 represents a cross-section according to line II—II in FIG. 1.
Figure 3:
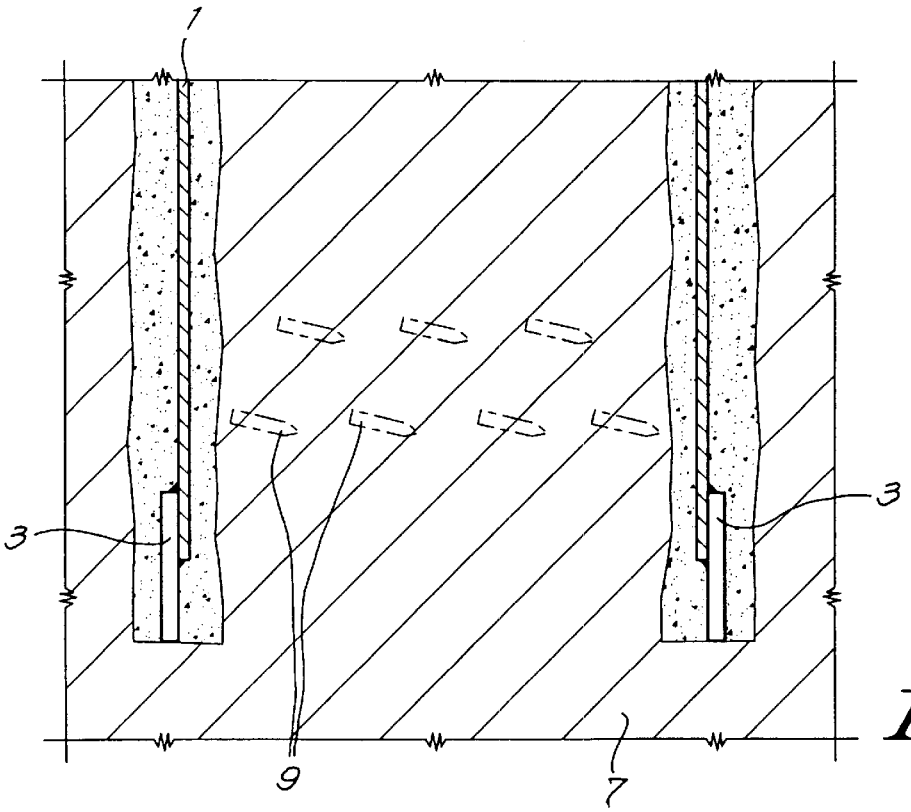
FIG. 3 represents a cross-section according to line III—III in FIG. 1.

For making a water-tight wall in the ground, drilling pipes are provided in the ground, at a distance from each other. Those drilling pipes can be provided one after the other or be drilled in in groups of several at the same time, in the represented example, two by two.

As represented in the figures, these drilling pipes comprise a cylindrical metal tubular element 1, open at its lower end, whereby teeth 2, 3 and 4 are welded to its lowermost end, which teeth protrude below from the tubular element 1.

The teeth 2 are welded closely to the inside of the tubular element 1 and protrude with their thickness 15 to 30, in the given example approximately 25, mm towards the inside. The teeth 3 are welded closely to the outside of the tubular element 1, but have a smaller thickness.

The teeth 4 are also welded to the outside of the tubular element 1, but are bent outward at the underside, such that they protrude there at a distance of approximately 40 to 50 mm beyond the outside. Depending on the condition of the ground, this dimension can be changed.

Figure 4:
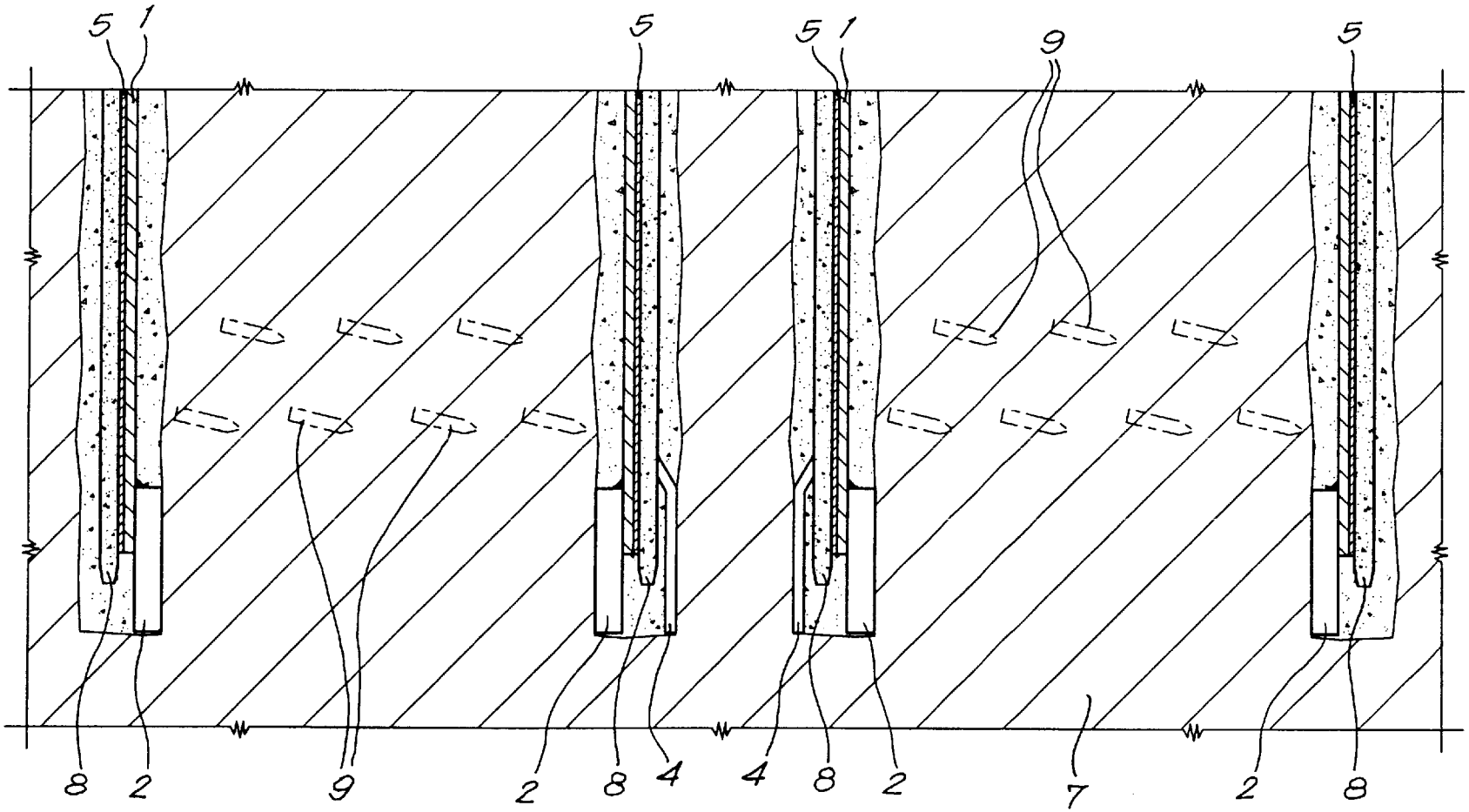
FIG. 4 represents a cross-section according to line IV—IV in FIG. 1.

Those teeth 2, 3 and 4 are provided alternately. The edges of the teeth 2, 3 and 4 which, when drilling into the ground, are situated in front in turning direction, are straight and sharp, the edges which are situated at the rear end may, as represented below, be rounded off below, as is visible in FIGS. 1 and 4.

In this latter case, the teeth 2, 3 and 4 thus are different depending on the drilling sense, and the two drilling pipes which are represented next to each other in the figures, differ from each other in that they have a different turning direction when being drilled in, such as indicated by arrows P1 and P2 in FIG. 1.

Two channel-shaped profiles 5, which are open with a narrow groove 6 at the outside, are welded diametrically opposite to each other to the outside of the tubular element 1, over the entire length.

These profiles 5 have an almost triangular cross-section which is open at the top, where, thus, the groove 6 is formed, whereas the leg which, in the rotational sense when drilling in, is situated in front, is somewhat longer than the other in order to avoid that the profile 5 is pressed together.

Before drilling a drilling pipe into the ground 7, in each profile an injection pipe 8 with, for example, a diameter of 20 mm is inserted from above up to below the tubular element 1. This injection pipe 8 is connected to a not represented pump which connects to a reservoir with hardening liquid, such as cement slurry, bentonite or a cement-bentonite-mixture.

For drilling in tough kinds of clay, metal strips 9 placed under an angle can be welded to the outside of the tubular element 1, above the teeth 2, 3, and 4.

The above-described drilling pipes are drilled into the ground 7 by means of a drilling device exerting a certain downward pressure, whereby adjacent drilling pipes are rotated in opposite sense, this as indicated by arrows P1 and P2, respectively, in FIG. 1.

During the rotation of the drilling pipe, a hardening liquid, in particular cement slurry, bentonite, or a cement-bentonite-mixture is pumped through the injection pipes provided in the profiles 5.

By means of the teeth 2, 3, and 4, at each drilling pipe a circular tube is formed where the ground is blended with the hardening liquid to a paste-like matter. This blending is even intensified by the possible strips 9.

Due to the size and location of the teeth 2, 3, and 4, the aforementioned tube is, for example, 15 to 30 mm at the inside and approximately 40 to 50 mm at the outside of the tubular element 1 of the drilling pipe.

Only such a quantity of hardening liquid is injected as is necessary for the downward progression of the drilling pipe. As this drilling pipe has reached the desired depth, injection is stopped and the injection pipes 8 are withdrawn from the profiles 5 while simultaneously the space in the profile 5 which is created under these injection pipes 8 is filled.

After hardening of the mixture of ground and hardening liquid, whereas the metal tubular element 1 remains in the ground 7, thus, a rather solid pillar is obtained.

The drilling pipes may be situated such that the mixtures of ground and hardening liquid situated at the outside of adjacent drilling pipes overlap each other and, thus, a water-tight wall is formed. The drilling pipes may also be situated at a larger distance to each other, as in the represented example.

The drilling pipes then are connected to the drilling device such and stopped in such a position that two profiles 5 of two adjacent drilling pipes are situated opposite to each other.

Immediately after the removal of the injection pipes 8 in these profiles 5 situated opposite to each other and still before hardening of the hardenable liquid injected in these profiles 5, from above a connecting profile 10 is slid with its longitudinal edges downward into these profiles 5.

Figure 5:
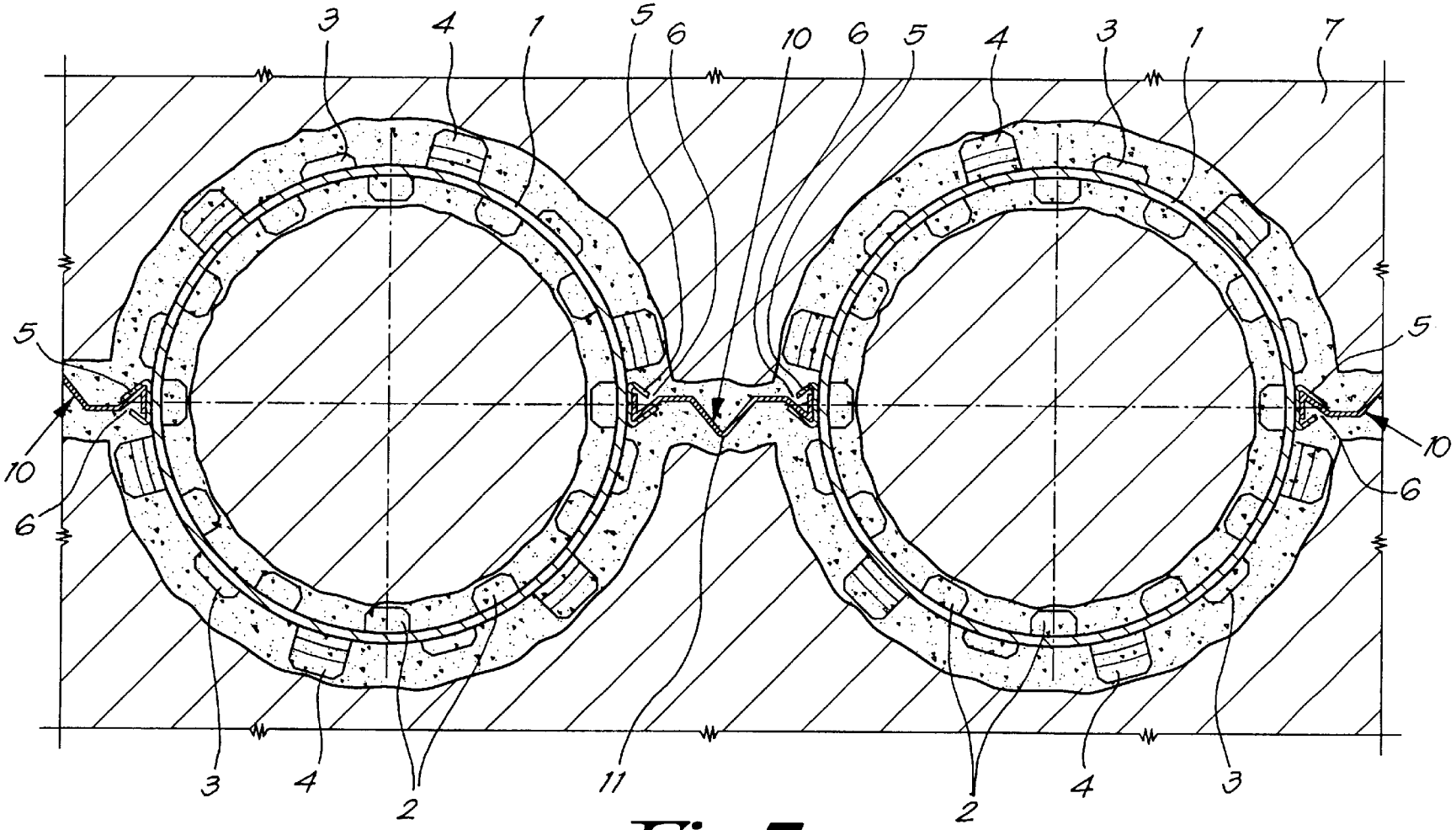
FIG. 5 represents a cross-section similar to that of FIG. 1, but after having formed a wall in the ground.

As represented in FIG. 5, in which this connecting panel 10 is represented as part of the wall, the edges thereof are bent under an acute angle, such that they fit into the triangular interior of the profiles 5.

This connecting profile 10 protrudes through the grooves 6 in the two profiles 5 and is designed as a sheet pile lock.

This connecting panel 10 protrudes through the grooves 6 in the two profiles 5 and is designed as a sheet pile lock.

The connecting panel 10 has in its middle a bend 11 forming a channel. In this bend 11, an injection pipe 8 can be provided with which, when bringing the connecting panel 10 into the ground, the aforementioned hardening liquid is injected.

After the connecting panel 10 has reached a sufficient depth, this injection pipe 8 is also withdrawn while injecting hardening liquid.

After hardening of the hardening liquid in the profiles 5 and along the connecting panel 10, the two adjacent pillars, together with the connecting profile 10, form a part of a water-tight wall.

At opposite sides of the aforementioned pair of drilling pipes, this wall can be enlarged by providing additional drilling pipes which are connected by a connecting panel 10, in the manner described heretofore, to the first-mentioned drilling pipes.

The quantity of ground which is blended with hardening liquid at each drilling pipe is smaller than with the known methods where all of the ground is blended inside the drilling pipe. Less blended ground means less waste to remove.

In consideration of the fact that, within each drilling pipe, no profile has to be provided, it is not necessary to blend the ground to a large amount of thin paste.

It is possible to exert a large vertical force upon the tubular element 1 in order to obtain a fast penetration into the ground.

The metal tubular elements 1 have a better carrying capacity and section modulus than I-profiles such that, for forming a wall, the drilling pipes can be brought into the ground 7 at a larger distance than with the known methods whereby the drilling rods are substituted by I-profiles and whereby the blends of ground and hardening liquid formed by the drilling rods have to overlap each other.

Whereas the tubular elements 1 provide for the strength, above all the hardened mixture of ground and hardening liquid provides for the watertightness.

The invention is in no way limited to the forms of embodiment described heretofore and represented in the appended drawings, on the contrary may such drilling pipe and method for forming a wall in the ground be realized in various variants without leaving the scope of the invention.

I claim:

1. A method for constructing an underground wall in a soil formation comprising the steps of:

arranging a plurality of drilling pipes in a predetermined pattern adjacent to one another, each of said drilling pipes having an open distal end, a plurality of radially extending teeth and at least one channel shaped profile extending along the length thereof;

rotatably driving each of said drilling pipes into the soil;

injecting a hardening liquid into soil loosened by said plurality of teeth such that said hardening liquid is agitated and mixed with said loosened soil as each of said drilling pipes is driven into the soil; and permitting a mixture of said loosened soil and said hardening liquid to solidify in situ in each of said drilling pipes.

2. The method of claim 1 wherein an injection pipe is provided in each of said channel shaped profiles, said hardening liquid being injected through said injection pipes.

3. The method of claim 2 further comprising the step of removing said injection pipes from said channel shaped profiles upon said drilling pipes being driven to a predetermined depth into said soil.

4. The method of claim 3 further comprising the step of injecting said hardening liquid as said injection pipes are withdrawn from said channel shaped profiles.

5. The method of claim 2 further comprising the step of removing said injection pipes from said channel shaped profiles upon said drilling pipes being driven to a predetermined depth into said soil, wherein each of said drilling pipes includes at least two of said channel shaped profiles oppositely opposed to one another.

6. The method of claim 5 further comprising the step of connecting each of said drilling pipes with a connecting panel, wherein each of said channel shaped profiles defines an exterior side having a groove configured to couple with one of said connecting profiles.

7. The method of claim 6 wherein said connecting panels define longitudinal edges configured to fit into said channel shaped profiles.

8. The method of claim 6 wherein each channel shaped profile defines a triangular shaped cross-section.

9. The method of claim 1 further comprising the step of rotatably driving said drilling pipes adjacently located to one another in opposite directions into the soil.

10. The method of claim 1 wherein one plurality of said teeth extend radially inward from an interior surface of said drilling pipes and another plurality of said teeth extend outward from an exterior surface of said drilling pipes.

11. The method of claim 10 wherein a plurality of said teeth extending from said interior surface extend in a range of about 15 to 30 mm from said interior surface and another plurality of said teeth extending from said exterior surface extend in a range of about 40 to 50 mm from said exterior surface.

12. The method of claim 1 wherein each of said drilling pipes includes at least one protrusion extending towards and beyond said open distal end.

13. The method of claim 1 wherein each of said drilling pipes includes a plurality of angular strips positioned along an exterior surface thereof above said plurality of teeth with respect to said open distal end.

14. The method of claim 1 wherein said hardening liquid is selected from the group consisting of cement, bentonite and a cement-bentonite mixture.

* * * * *